United States Patent [19]

Davidson

[11] Patent Number: 4,619,055

[45] Date of Patent: Oct. 28, 1986

[54] CUSHIONING PAD

[76] Inventor: Murray R. Davidson, P.O. Box 27087, San Diego, Calif. 92128

[21] Appl. No.: 666,273

[22] Filed: Oct. 29, 1984

[51] Int. Cl.[4] ..... A43B 13/18

[52] U.S. Cl. ..... 36/28; 36/3 B; 36/29; 36/44

[58] Field of Search ..... 36/28, 30 R, 29, 43, 36/44, 3 B, 3 R

[56] References Cited

U.S. PATENT DOCUMENTS

| | | | |
|---|---|---|---|
| 895,950 | 8/1908 | Von Bracht | 36/3 B |
| 2,207,632 | 7/1940 | Margolin | 36/44 |
| 2,553,616 | 5/1951 | Walls | 36/29 |
| 2,558,973 | 7/1957 | Meaker | 36/3 B |
| 4,012,855 | 3/1977 | Gardner | 36/29 |
| 4,075,772 | 2/1978 | Sicurella | 36/43 |
| 4,223,455 | 9/1980 | Vermeulen | 36/3 B |
| 4,316,335 | 2/1982 | Giese et al. | 36/28 |
| 4,336,661 | 6/1982 | Medrano | 36/44 |
| 4,356,642 | 11/1982 | Herman | 36/44 |
| 4,438,573 | 3/1984 | McBarron | 36/3 B |
| 4,485,568 | 12/1984 | Landi et al. | 36/28 |

*Primary Examiner*—Werner H. Schroeder
*Assistant Examiner*—Mary A. Ellis
*Attorney, Agent, or Firm*—Gregory J. Nelson

[57] ABSTRACT

A cushioning pad or mat for protecting the human foot and body while walking or standing. The mat is of a bonded, multi-layer construction with an upper moisture-absorbing layer, an intermediate resilient layer of foam rubber which will mold to the individual's particular foot contour and irregularities and a lower shock-absorbing layer of soft natural latex rubber which is resilient and has memory. Air holes are provided at spaced intervals through the mat and the special cellular design provides a bellows action to enhance the flow of air around and through the mat as well as to improve blood circulation in the extremities of the user. In the preferred embodiment, the mat is configured as an insole for insertion of footwear. In other embodiments, the mat may be used as protective knee pads, helmet liners and the like.

5 Claims, 6 Drawing Figures

CUSHIONING PAD

The present invention relates to a cushioning pad and more particularly relates to a cushioning pad which may be incorporated into a shoe insole and for similar applications to relieve pressure on adjacent portions of the user's anatomy.

Many professions and occupations require that the individual worker stand for long periods of time. Typical occupations that require an extended or protracted periods of standing and walking are factory workers such as machinists or assemblers, food service personnel, postal workers, barbers, beauticians and many others. Long periods of standing, particularly on hard floors or surfaces, often results in fatigue, tired legs, sore hips and back. In fact, it is estimated that some seventy-five percent of the American public has back pain or back fatigue. Standing or working for eight hours or so causes a pooling of the blood and body fluids in the lower extremity resulting in edema, fatigue, tired feet, sore arches, knee pains, circulation problems, varicose veins and the like. Quite simply, humans are not adapted to stand for extended periods on hard surfaces. Man as we know him has been on this planet for about four million years. During that time man evolved on grassy plains, forest floors and sandy beaches. However, in the last one hundred fifty years, as a result of industrialization, man spends much of his time walking, working and playing on hard, paved surfaces. As mentioned above, the prevelance of hard, nonresilient surfaces has taken its toll.

As a result of the problems encountered or imposed by prolonged periods of standing or walking on such hard surfaces, fatigue mats have come into use. Generally a fatigue mat consists of carpeting with some sort of foam or shock-absorbant backing which is placed around work areas such as machines, barber chairs, and duty stations of food service workers. These mats serve to somewhat cushion the effects of hard surfaces. Manufacturing facilities use such mats extensively, particularly in machine shop and assembly areas. The drawback with such mats is that their use is limited since such mats cannot be used in areas where equipment is being moved. Such standard fatigue mats have other disadvantages:

1. Oil, water or chemicals that may spill upon them and make them slippery and therefore unsafe;

2. Debris and metal filings and machine metal curls may get imbedded in these mats, making them difficult to use or causing them to deteriorate over prolonged use;

3. Such mats pose a problem for janitorial services because the mats must be lifted for cleaning and the mats themselves must be cleaned which imposes additional work on the cleaning personnel.

4. The most important deficiency of such conventional fatigue mats are that they are stationary and do not travel with the worker when the worker leaves the duty station or work area.

There are various foot cushioning devices in the prior art which are insertable in footwear such as foam rubber insoles. These insoles serve to some extent to lessen the detrimental effects of hard surfaces but generally these pads are of limited effectiveness and deteriorate quickly or compact so that their cushioning effectiveness is quickly sacrificed. One particularly effective foot cushioning device is shown in my prior patent, U.S. Pat. No. 4,179,826 issued Dec. 25, 1979 for "Foot Cushioning Device". This device is a novel and unique heel cup but is designed more specifically for individuals engaged in athletic and active endeavors such as joggers, runners, hikers, football and soccer players and the like. While this device is highly effective and has achieved a high degree of commercial success, the device is primarily aimed at cushioning the effects of heel strike and not designed to reduce the effects of prolonged periods of standing. Accordingly, there exists a need for an effective and portable or transient cushioning pad or mat.

As a result of the foregoing, the present invention provides a new comfort product for reducing fatigue in the foot, leg, and back imposed by prolonged periods of bodily contact with hard surfaces. The present invention may be best termed a portable, personal fatigue mat. The fatigue mat consists of multi-layered cushion structure which, in the preferred embodiment, is configured as an insole to be worn in footwear. The bottom of the three layers consists of a cushion made of a very soft natrual latex rubber having a cellular design which provides permanent "memory" and absorbs shock due to compression and deformation of the cells. The intermediate layer is of neoprene foam rubber which molds to an individual's particular foot contour and shape as it is used. These layers are bonded to a top cover of strong nylon. Air channels are provided through the layers and through the individual cells at spaced-apart locations to provide a good ventilation and for hygienic reasons. The cushioning material may also be configured in other products such as knee pads, helmet liners and the like.

The detailed construction, use and advantages of the present invention will be more fully understood from the following description, claims and drawings in which:

Figure 1:
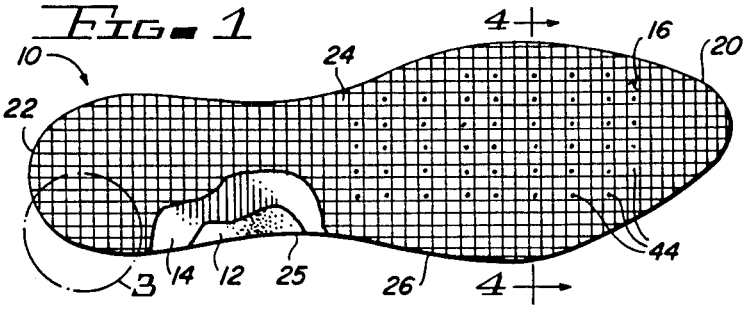
FIG. 1 is a bottom view of a preferred embodiment of the cushioning pad of the present invention partly broken away.
Figure 2:
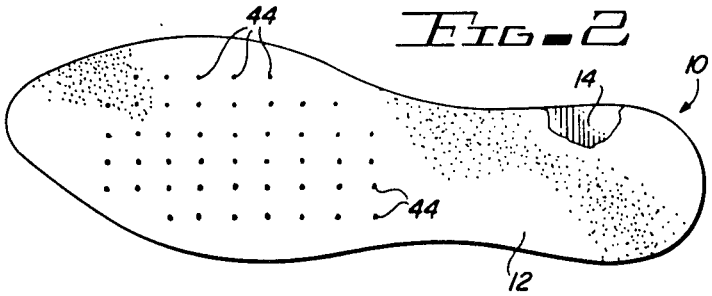
FIG. 2 is a top view of the pad of FIG. 1 partly broken away to illustrate the various layers.

Turning now to the drawings, FIGS. 1 through 4 show a preferred embodiment of the cushioning pad of the present invention which is generally designated by the numeral 10. Embodiment 10 is a cushion in the form of an insole and is shown adapted for use with the left foot of the wearer insertable in footwear. The cushioning pad 10 is a laminated structure comprising an upper or top laminate or layer 12, an intermediate layer 14 and bottom layer 16. The pad is, as mentioned above, in the form of an insole adapted for insertion in a shoe or other footwear and has a curved toe portion 20, curved heel portion 22, and opposite sides 24 and 26. Sides 24 and 26 are configured to conform to the shape of the foot having, for example, a long indentation 25 which corresponds to the long medial arch of the foot.

Figure 3:
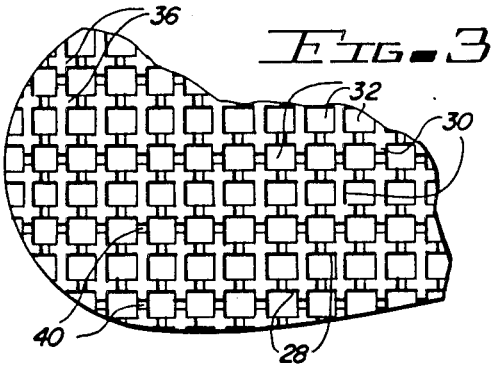
FIG. 3 is a detail view of a portion of the pad as indicated in FIG. 1.
Figure 4:
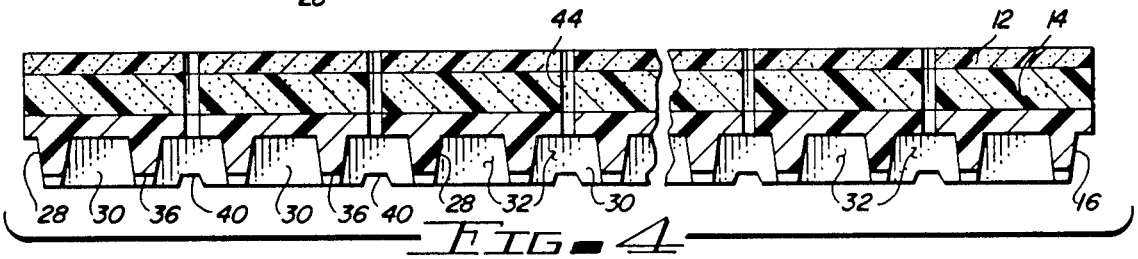
FIG. 4 is a transverse sectional view of the cushioning pad taken along lines 4—4 of FIG. 1.

As best seen in FIGS. 3 and 4, the bottom layer 16 of the cushioning mat or pad is formed from a resilient material, preferably a very soft natural latex rubber, having the characteristic of permanent "memory". That is, the material is deformable and resilient upon application of force and when force is removed, the material will return to its original shape. Other materials including synthetic rubbers and plastics having these characterics will become apparent to those skilled in the art.

The bottom layer 16 is preferably molded having longitudinally extending ribs 28 and transversely extending ribs 30 which intersect to form a plurality of individual, generally rectangular cells 32. The individual ribs 28 and 30 project downwardly from the base 34 approximately ⅛ inches. The individual cells may vary in size but are typically approximately one-quarter inch square. The cellular design closely duplicates the method of absorbing shock in the heel pad of the human foot as the individual cells provide columns of air which will deflect and compress to absorb shock. The longitudinal ribs define transversely arranged notches 36. Similarly, the transversely extending ribs 30 define longitudinally arranged notches 40. The notches may be in alternately spaced rows with the result that both transverse and longitudinal air channels are provided communicating with a substantial number of the individual cells 32.

Intermediate layer 14 is typically one-sixteenth to three-eighths inch thick and preferably of a resilient material such as neoprene foam rubber which has the characteristic of molding or shaping under continued application of pressure. Thus, as the insole is worn by the user, the intermediate layer tends to conform to the particular foot contour and irregularities of the individual wearer providing a comfortable and personalized "feel". The intermediate layer 14 and the lower layer 16 are bonded together by application of heat and/or adhesive as is well known to those in the arts. The particular method of bonding may vary but bonding techniques similar to those used in the manufacture of conventional swimmer's and diver's wetsuits is preferred.

The upper layer or cover 12 is primarily for moisture absorption and consists of a suitable moisture-absorbing material such as nylon. The nylon, again, is bonded to the upper surface of the intermediate layer 14 by conventional bonding techniques known to those skilled in the art.

In use, the cushioning mats or pads may be provided to the user in various sizes and shapes for insertion in shoes or may be provided in blank form and trimmed to the desired shape by the user. The unique construction provides substantial advantages. The upper layer serves to provide comfort and absorbs moisture. The intermediate layer 14 conforms to the contours of the foot of the user. The lower or bottom layer consisting of the individual cellular shock absorbers cushions the wearer's foot to relieve fatigue to the feet, knees, legs and back. A significant advantage is that the individual cells or grids 32 permit air circulation across the pad to the foot of the wearer via notches 36 and 40 arranged with the ribs defining the cell walls. In addition, a plurality of air holes 44 are provided at multiple spaced-apart locations in various channels extending through the base layer 34, intermediate layer 14 and upper layer 12. The location and spacing of the holes may vary but is preferred that the holes be located on approximately ½" grid spacing. This allows air transfer in, around and under the cushioning pad. These individual cells which are in communication with the air passageways or notches, serve as small bellows or air pumps to assist in air circulation.

A further advantage is that the individual cells 32 serve to assist in circulating blood through the body. The muscles in the lower extremities of the body act as an auxilliary pump. The heart in the human pumps blood throughout the body system and is pressed back into the atriums of the heart and recirculated again. However, when blood is pumped down to the feet, the peripheral venus pump mechanism made up of muscles in the leg squeezes the veins and forces blood back to the heart. The flexing and deformation of the individual cells against the foot assists the peripheral venus pump mechanisms to force blood back to the heart. In addition, shock on the foot and remainder of the body of the wearer is reduced as shock is dissipated in the deformation of the individual cells. Accordingly, fatigue is reduced and less strain is placed on the skeletal structure of the user.

Figure 5:
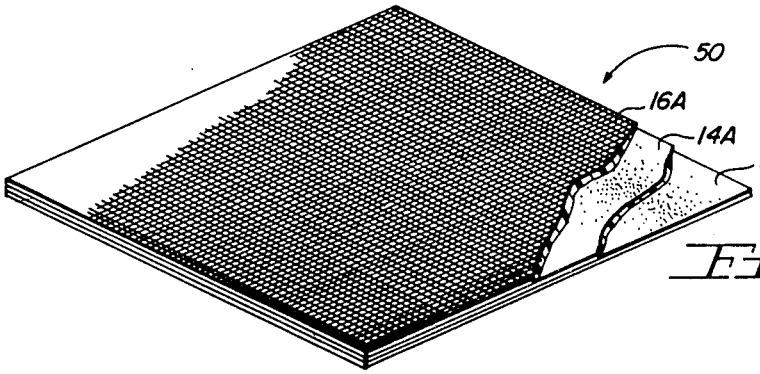
FIG. 5 is a bottom perspective view of another embodiment in the form of a stationary pad or mat constructed according to the present invention.

In FIG. 5, which is a bottom perspective view, the fatigue mat of the present invention is designated by the numeral 50 and again constructed as a laminated structure having the moisture absorbing top cover 12A, intermediate layer 14A which conforms to the foot and bottom cushioning structure 16A consisting of the grid-like or egg crate cells defined by intersecting ribs. The cushioning pad 50 of this embodiment is shown as being generally rectangular, however, any geometric shape could be utilized consistent with the requirements of the user. The mat is a stationary mat positioned in the work area and as long as the worker is standing on it, provides the benefits desribed above. The disadvantage of the permanent mat is that these benefits are achieved only as long as the worker is standing on the mat, whereas with the previous embodiment the cushioning device is considered a "personal" cushioning device that remains with the user.

Figure 6:
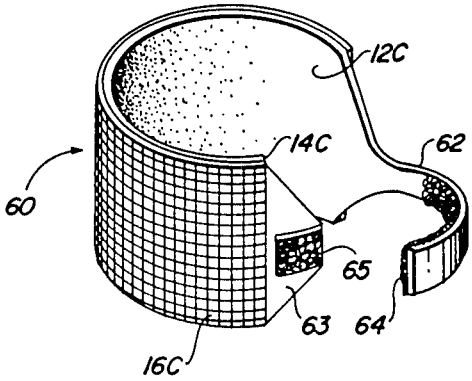
FIG. 6 is a perspective view of a knee pad incorporating the cushioning structure illustrated in FIGS. 1 to 4.

In addition to the foregoing, the unique cushioning structure described above may be incorporated in other objects and devices. In FIG. 6, a knee pad 60 is shown again constructed of the laminate structure with a cover 12B, intermediate layer 14C and cushioning layer 16C. The knee pad is shown as generally rectangular and is curved in both the lateral and longitudinal directions so as to cover the patella and knee area of the user. A strap 62 extends from one side of the knee pad so that the pad can be secured to the knee of the user with the strap extending about the back of the leg of the user and secured at tab 63 by cooperating hook and pile members 64 and 65. Knee pads of this type can be used by athletes as a protective measure and as well as use by construction workers, gardeners, and others who find it necessary to remain on their knees for a long period of time. Again, the cushioning layer 16C tends to absorb shock while providing the pumping and massage action to the adjacent body area of the user.

From the foregoing, it will be apparent that the present invention provides a unique cushioning device having substantial applications. The particular peripheral configuration of the pad may vary in accordance with the particular application, as for example, the cushioning device may be an insole, knee pad, helmet liner or the like. Accordingly, it will be obvious to those skilled in the art to make various changes, alterations and modifications to the cushioning device described above and also to find numerous other applications for the cushioning material. These various changes, alterations, and modifications are accordingly intended to be encompassed within the spirit and scope of the appended claims.

I claim:

1. A cushioning mat comprising:

(a) an upper laminate of material having moisture-absorbant characteristics;

(b) an intermediate laminate having an upper and lower surface, said upper surface being bonded to the lower surface of said upper laminate, said intermediate laminate being resilient and permanently deformable over prolonged application of pressure;

(c) a lower cushioning pad having a base layer having an upper and lower surface, said upper surface of said base layer being bonded to the lower surface of said intermediate layer;

(d) a plurality of generally spaced-apart longitudinally and transversely extending ribs extending from the lower surface of said base defining a plurality of cells, said ribs having memory to return to the original shape upon removal of deformation forces and being resilient to flex and deform under application of pressure to cushion shock; and (e) said ribs defining first air passageways placing said cells in communication with one another and wherein said laminate and pad define second air passageways at selected locations whereby air flow is induced through the mat and between the cells as the mat is flexed.

2. The mat of claim 1 wherein said upper laminate is nylon.

3. The cushioning mat of claim wherein said intermediate layer is neoprene rubber.

4. The cushioning mat of claim 1 wherein said lower cushioning pad is molded as a unitary structure of natural latex rubber.

5. The cushioning mat of claim 1 wherein said laminate has a peripheral configuration generally conforming to the shape of the human foot.

* * * * *